US010139771B2

(12) United States Patent
Yago

(10) Patent No.: US 10,139,771 B2
(45) Date of Patent: Nov. 27, 2018

(54) IMAGE FORMING APPARATUS

(71) Applicant: CANON KABUSHIKI KAISHA, Tokyo (JP)

(72) Inventor: Toshihisa Yago, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/495,270

(22) Filed: Apr. 24, 2017

(65) Prior Publication Data

US 2017/0329266 A1 Nov. 16, 2017

(30) Foreign Application Priority Data

May 16, 2016 (JP) ..... 2016-098076

(51) Int. Cl.

| | |
|---|---|
| ***G03G 21/00*** | (2006.01) |
| ***G03G 15/00*** | (2006.01) |
| ***G03G 15/01*** | (2006.01) |
| ***G03G 15/08*** | (2006.01) |
| *G03G 15/09* | (2006.01) |

(52) U.S. Cl.

CPC ..... *G03G 21/007* (2013.01); *G03G 15/0189* (2013.01); *G03G 15/0853* (2013.01); *G03G 15/50* (2013.01); *G03G 21/0029* (2013.01); *G03G 15/09* (2013.01)

(58) Field of Classification Search

CPC ..... G03G 15/0189; G03G 15/0853; G03G 21/0029; G03G 21/007; G03G 2215/0888; G03G 2221/1618; G03G 2221/163

USPC ..... 399/53, 61, 63, 119, 123, 351

See application file for complete search history.

(56) References Cited

U.S. PATENT DOCUMENTS

| | | | | |
|---|---|---|---|---|
| 6,954,595 | B2 | 10/2005 | Tsukida et al. | |
| 2004/0141779 | A1* | 7/2004 | Yanagida ..... | G03G 21/1814 399/350 |
| 2010/0260507 | A1* | 10/2010 | Kakubari ..... | G03G 15/0893 399/30 |

FOREIGN PATENT DOCUMENTS

| | | | |
|---|---|---|---|
| JP | H11-84853 | A | 3/1999 |
| JP | 2004-110011 | A | 4/2004 |
| JP | 2006-119479 | A | 5/2006 |

(Continued)

OTHER PUBLICATIONS

Table of Electrical Resistivity and Conductivity—https://www.thoughtco.com/table-of-electrical-resistivity-conductivity-608499.*

*Primary Examiner* — Benjamin Schmitt

(74) *Attorney, Agent, or Firm* — Fitzpatrick, Cella, Harper & Scinto

(57) ABSTRACT

An image forming apparatus includes an intermediate transfer member bearing a toner image and image forming units arranged side by side, with each image forming unit having a developing device forming the toner image, a magnetic permeability sensor detecting a toner density of a developer in the developing device, and a cleaning unit having a cleaning member which removes toner remaining on an image bearing member and a conductive support member which supports the cleaning member. The apparatus further includes a conductive member facing the magnetic permeability sensor of the most upstream image forming unit and arranged upstream of that image forming unit. The developing device of one of adjacent image forming units is opposed to the cleaning unit of another unit which is arranged downstream and is next to the developing device of the one of the adjacent image forming units.

8 Claims, 6 Drawing Sheets

(56) References Cited

FOREIGN PATENT DOCUMENTS

JP 2009-192978 A 8/2009

* cited by examiner

IMAGE FORMING APPARATUS

BACKGROUND OF THE INVENTION

Field of the Invention

The present invention relates to an image forming apparatus using an electrophotographic technology, such as a printer, a copying machine, a facsimile machine, or a multifunction peripheral.

Description of the Related Art

Hitherto, there has been known an image forming apparatus having a so-called tandem configuration in which image forming units, each including a photosensitive drum and a developing device, are arranged side by side along a direction of travel of an intermediate transfer belt or a recording material. There has also been known an image forming apparatus employing, as a development method, a dual-component development method using a two-component developer (hereinafter referred to simply as "developer") that is a mixture of a non-magnetic toner and a magnetic carrier.

In a case of the dual-component development method, the toner contained in the developer is used for development and consumed. Along with the consumption, a toner density of the developer stored in each of developing containers is decreased. The toner density is a ratio (percentages) of a weight of the toner to a total weight of the developer, and is also referred to as "TD ratio". The developer having an excessively decreased toner density causes an image defect. Therefore, in the image forming apparatus, the developer can be replenished to each of the image forming units as needed in accordance with the toner density of the developer. In order to detect the toner density of the developer for each of the image forming units, a magnetic permeability sensor capable of detecting a magnetic permeability of the developer is mounted to each of the developing containers (Japanese Patent Application Laid-Open No. H11-84853).

In recent years, the image forming units are downsized to further downsize the image forming apparatus having the tandem configuration. Further, each of the image forming units is arranged while an interval between the adjacent image forming units is reduced as much as possible. In this case, the magnetic permeability sensor of the developing device of one of the adjacent image forming units is provided in proximity to the photosensitive drum of another of the image forming units. On the photosensitive drum, a cleaning blade configured to remove a transfer residual toner remaining on the photosensitive drum after transfer is supported by a support member having conductivity. Thus, as the interval between the image forming units becomes smaller, the magnetic permeability sensor is more magnetically affected by the support member.

For the image forming unit (referred to as "most upstream unit" for convenience) arranged most upstream with respect to the direction of travel of the intermediate transfer belt (or the recording material), no image forming unit is provided on an upstream side on which the magnetic permeability sensor is mounted. Specifically, there is no support member in proximity to the magnetic permeability sensor of the most upstream unit, and the most upstream unit is therefore not affected by the support member in contrast to the other image forming units. When the tandem-type image forming apparatus is to be downsized, the image forming units are classified into the image forming unit including the magnetic permeability sensor that is affected by the support member and the image forming unit including the magnetic permeability sensor that is not affected by the support member. As a result, the image forming units sometimes have different results of detection although the toner densities are actually the same.

SUMMARY OF THE INVENTION

It is an object of the present invention to provide an image forming apparatus capable of stabilizing outputs from magnetic permeability sensors provided to respective image forming units arranged side by side.

It is another object of the present invention to provide an image forming apparatus, including: a plurality of image forming units arranged side by side in a predetermined direction, each of the plurality of image forming units having: an image bearing member; a developing device configured to store a developer containing a magnetic carrier and a toner and to form a toner image on the image bearing member; a magnetic permeability sensor that is mounted to the developing device, and is configured to detect a toner density of a developer in the developing device; and a cleaning unit having a cleaning member configured to remove a toner remaining on the image bearing member, and a conductive support member configured to support the cleaning member; a rotatable intermediate transfer member opposing to the plurality of image forming units, and configured to bear a toner image formed in each of the plurality of image forming units; and a conductive member facing the magnetic permeability sensor of one image forming unit of the plurality of image forming units positioned most upstream in a rotational direction of the intermediate transfer member, and arranged upstream of the one image forming unit positioned most upstream in the rotational direction, wherein the developing device of one of adjacent image forming units of the plurality of image forming units is arranged so as to be opposed to the cleaning unit of another of the adjacent image forming units, which is arranged downstream in the rotational direction and is next to the developing device of the one of the adjacent image forming units.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
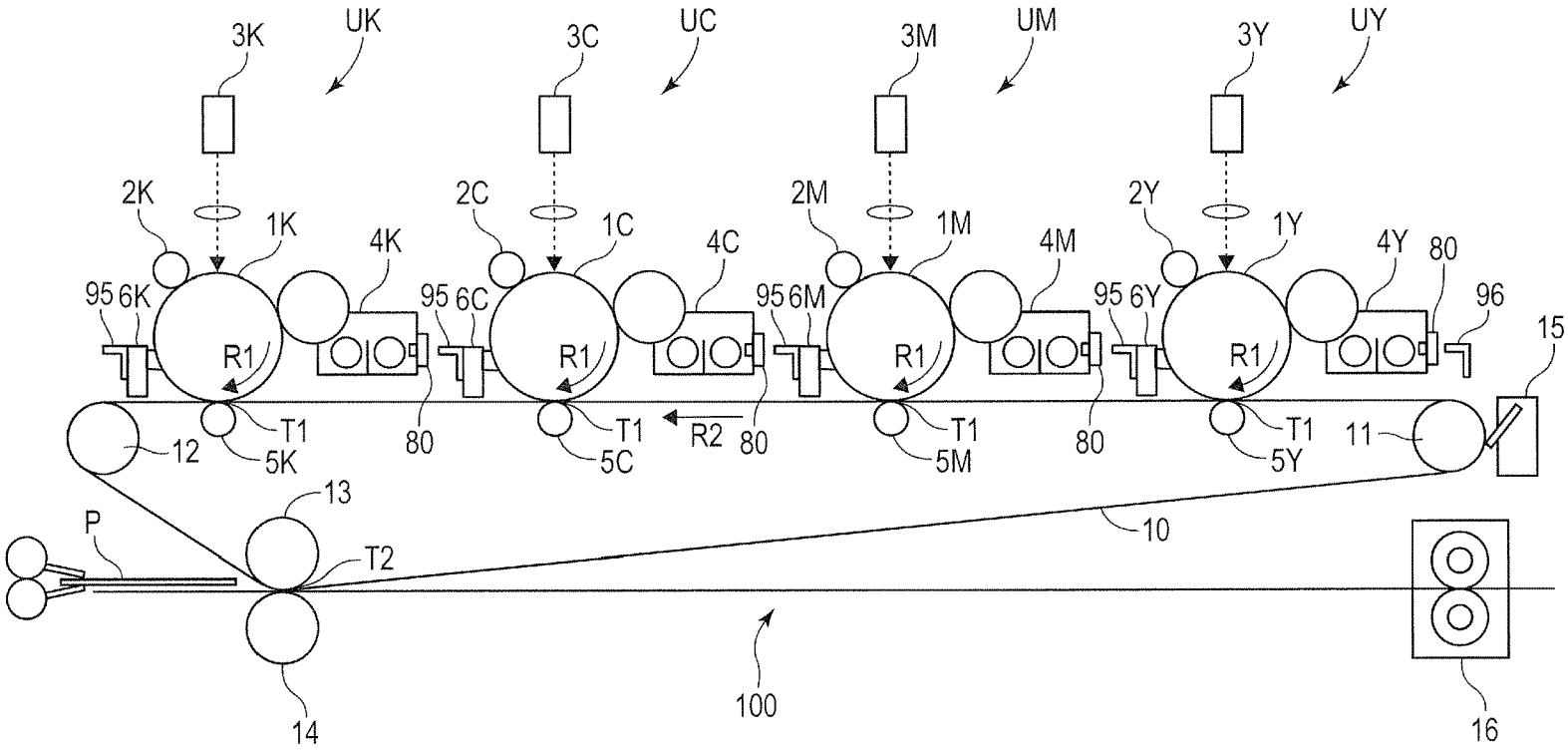
FIG. 1 is a schematic view for illustrating a configuration of an image forming apparatus according to a first embodiment of the present invention.

A schematic configuration of an image forming apparatus according to a first embodiment of the present invention is described with reference to FIG. 1. An image forming apparatus 100 illustrated in FIG. 1 is a full-color printer having a tandem configuration using an intermediate transfer process. In the image forming apparatus 100, image forming units UY, UM, UC, and UK are arranged along a direction of travel of an intermediate transfer belt 10 (intermediate transfer member), that is, a predetermined direction, namely, a direction indicated by the arrow R2 in FIG. 1.

<Image Forming Unit>

In the image forming unit UY, a yellow toner image is formed on a photosensitive drum 1Y and is then transferred onto the intermediate transfer belt 10. In the image forming unit UM, a magenta toner image is formed on a photosensitive drum 1M and is then transferred onto the intermediate transfer belt 10. In the image forming unit UC, a cyan toner image is formed on a photosensitive drum 1C and is then transferred onto the intermediate transfer belt 10. In the image forming unit UK, a black toner image is formed on a photosensitive drum 1K and is then transferred onto the intermediate transfer belt 10. The toner images of the four colors transferred onto the intermediate transfer belt 10 are conveyed to a secondary transfer portion T2 and transferred onto a recording material P (sheet material such as a paper sheet and an OHP sheet) at a time.

The image forming units UY, UM, UC, and UK are configured in substantially the same manner except for differences of colors of the toners to be used in developing devices 4Y, 4M, 4C, and 4K, specifically, yellow, magenta, cyan, and black. Configurations and operations of the image forming units UY, UM, UC, and UK are described below with omission of the suffixes of Y, M, C, and K in the reference symbols, which allow distinction between the image forming units UY, UM, UC, and UK.

In the image forming unit U, a primary charger 2, an exposure device 3, the developing device 4, a primary transfer roller 5, and a cleaning unit including a cleaning blade 6 and a support member 95 are arranged so as to surround the photosensitive drum 1 serving as an image bearing member. In the photosensitive drum 1, a photosensitive layer is formed on an outer peripheral surface of a cylinder made of aluminum. The photosensitive drum 1 is rotated at a predetermined process speed in a direction indicated by the arrow R1 of FIG. 1.

The primary charger 2 is, for example, a charging roller formed into a roller shape, and is brought into contact with the photosensitive drum 1 with a charging bias voltage applied thereto. As a result, the primary charger 2 charges the photosensitive drum 1 with a uniform negative-polarity dark portion potential. In the exposure device 3, a laser beam obtained by ON-OFF keying of scanning-line image data obtained by developing a decomposed color image of each of the colors is generated from a laser emitting device. The exposure device 3 writes an electrostatic image of an image on a surface of the charged photosensitive drum 1 by scanning with the laser beam by a rotating mirror. The developing device 4 supplies the toner to the photosensitive drum 1 to develop the electrostatic image into the toner image. The developing device 4 is described in detail later with reference to FIG. 2 and FIG. 3.

The primary transfer roller 5 serving as a transfer unit is arranged so as to be opposed to the photosensitive drum 1 across the intermediate transfer belt 10. The primary transfer roller 5 forms a primary transfer portion T1 for the toner image between the photosensitive drum 1 and the intermediate transfer belt 10. In the primary transfer portion T1, a transfer voltage is applied to the primary transfer roller 5 by a high-voltage power supply (not shown). As a result, the toner image is primarily transferred from the photosensitive drum 1 onto the intermediate transfer belt 10.

A primary transfer residual toner slightly remaining on the photosensitive drum 1 (image bearing member) after the primary transfer is removed by the cleaning blade 6 serving as a cleaning member. The cleaning blade 6 is provided on a side opposite to the developing device 4 across the photosensitive drum 1 in the direction of travel of the intermediate transfer belt 10. The cleaning blade 6 is a plate-like elastic member made of, for example, a non-magnetic material such as polyurethane. The cleaning blade 6 is arranged downstream of the primary transfer portion T1 in a direction of rotation of the photosensitive drum 1 and upstream of the primary charger 2 in the direction of rotation of the photosensitive drum 1. The cleaning blade 6 is provided along a direction of a rotation axis, that is, a longitudinal direction of the photosensitive drum 1. The cleaning blade 6 is supported by the support member 95 so as to rub the surface of the photosensitive drum 1. The support member 95 is formed by using a metal plate having high stiffness and conductivity such as stainless steel (SUS) or aluminum.

The intermediate transfer belt 10 serving as another image bearing member is looped around a drive roller 11, a tension roller 12, and an inner secondary transfer roller 13 to be supported thereby. The intermediate transfer belt 10 is driven by the drive roller 11 to rotate in the direction indicated by the arrow R2 of FIG. 1. The secondary transfer portion T2 is formed by bringing an outer secondary transfer roller 14 into abutment against the intermediate transfer belt 10 supported by the inner secondary transfer roller 13, and is a nip portion for transferring the toner images onto the recording material P. At the secondary transfer portion T2, a secondary transfer voltage is applied to the outer secondary transfer roller 14. In this manner, the toner images are secondarily transferred from the intermediate transfer belt 10 onto the recording material P conveyed to the secondary transfer portion T2. A secondary transfer residual toner remaining on and adhering to the intermediate transfer belt 10 after the secondary transfer is removed by a belt cleaning device 15 rubbing the intermediate transfer belt 10.

The recording material P onto which the toner images of the four colors are secondarily transferred at the secondary transfer portion T2 is conveyed to a fixing device 16. The fixing device 16 applies a pressure generated by two rollers or belts opposed to each other and, in general, applies heat generated by a heat source (not shown) such as a heater to fuse and firmly fix the toner images onto the recording material P. The recording material P onto which the toner images are fixed by the fixing device 16 is delivered out of an apparatus body.

<Developing Device>

The developing device 4 of the first embodiment is described with reference to FIG. 2 and FIG. 3. The developing device 4 includes, as illustrated in FIG. 2, a restricting blade 20, a developing container 40 forming a housing, a developing sleeve 50 as a developer carrying member, a developing screw 60 as a first conveying member, and an agitating screw 61 as a second conveying member.

In the developing container 40, a two-component developer containing a non-magnetic toner and a magnetic carrier is stored. Specifically, a dual-component development method is used as a development method in the first embodiment, and the non-magnetic toner having negative charging polarity and the magnetic carrier having positive charging polarity are mixed to be used as the developer. The non-magnetic toner contains a colorant, an external additive such as colloidal silica fine powder, and further a wax in a resin such as polyester or styrene acrylic, and is formed as powder through grinding or polymerization. The magnetic carrier is formed by providing a resin coating on a surface layer of a core made of resin particles in which ferrite particles or magnetic powder is kneaded. A toner density (TD ratio) of the developer in an initial state is, for example, 8%.

Figure 2:
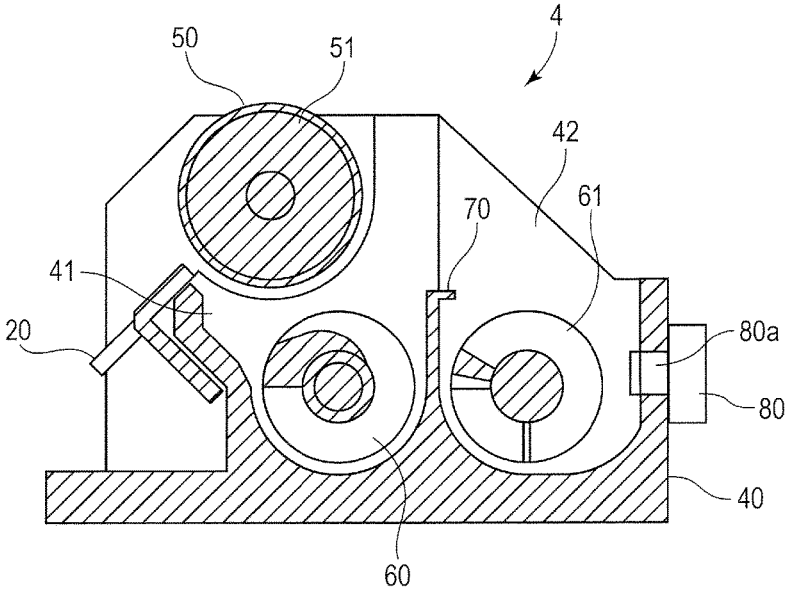
FIG. 2 is a sectional view for illustrating a developing device.
Figure 3:
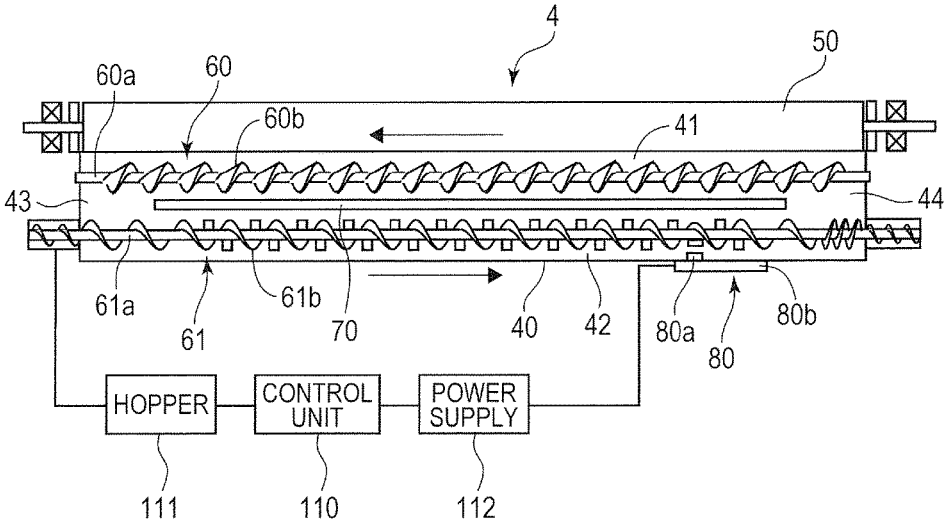
FIG. 3 is a top sectional view for illustrating the developing device on a horizontal cross section containing an axial direction.

As illustrated in FIG. 2, the developer 40 has an opening portion at a position opposed to the photosensitive drum 1. In the opening portion, the developing sleeve 50 is arranged rotatably so as to be partially exposed. The developing sleeve 50 is formed of a non-magnetic material such as aluminum or stainless steel into a cylindrical shape. The developing sleeve 50 is rotated in the same direction on a surface opposed to the photosensitive drum 1. Inside the developing sleeve 50, a magnet roller 51 serving as a magnetic field generating unit is fixed and arranged. With a magnetic force of the magnet roller 51, magnetic bristles of the developer are formed on a surface of the developing sleeve 50. The magnetic bristles formed on the surface of the developing sleeve 50 are sent to a predetermined developing region after a layer thickness thereof is restricted by the restricting blade 20. The restricting blade 20 is a plate-like member made of a non-magnetic material such as aluminum. The restricting blade 20 is arranged along the direction of the rotation axis, that is, a longitudinal direction of the developing sleeve 50. The magnetic bristles sent to the developing region rub the photosensitive drum 1 to develop an electrostatic latent image formed on the photosensitive drum 1 into the toner image.

In an approximate center portion of the developing container 40, a partition wall 70 extends in a vertical direction of FIG. 2. The developing container 40 is partitioned in a horizontal direction by the partition wall 70 into a developing chamber 41 positioned on the left and an agitating chamber 42 positioned on the right in FIG. 2. As illustrated in FIG. 3, the developing chamber 41 and the agitating chamber 42 communicate with each other through a first communication portion 43 and a second communication portion 44, which are provided at respective ends of the partition wall 70, to thereby form a circulation path of the developer.

The developing screw 60 is arranged rotatably in the developing chamber 41 serving as a first chamber. The agitating screw 61 is arranged rotatably in the agitating chamber 42 serving as a second chamber. The developing screw includes a screw structure having a first blade 60*b* provided spirally around a rotary shaft 60*a*. The agitating screw 61 has a screw structure having a second blade 61*b* provided spirally around a rotary shaft 61*a*.

The developing screw 60 is arranged along the direction of the rotation axis of the developing sleeve 50 approximately in parallel to the rotation axis inside the developing chamber 41. The agitating screw 61 is arranged approximately in parallel to the developing screw 60 inside the agitating chamber 42. When the developing screw 60 is rotated, the developer in the developing chamber 41 is conveyed from the right side to the left side in FIG. 3 along the rotary shaft 60*a* of the developing screw 60. The developer conveyed inside the developing chamber 41 is passed from the developing chamber 41 to the agitating chamber 42 through the first communication portion 43. When the agitating screw 61 is rotated, the developer in the agitating chamber 42 is conveyed from the left side to the right side in FIG. 3 (specifically, conveyed in a direction opposite to the direction in which the developer in the developing chamber 41 is conveyed) along the rotary shaft 61*a* of the agitating screw 61. The developer conveyed inside the agitating chamber 42 is passed from the agitating chamber 42 to the developing chamber 41 through the second communication portion 44. In the developer conveyed while being agitated by the developing screw 60 and the agitating screw 61, the toner is charged to negative polarity, whereas the carrier is charged to positive polarity.

<ATR Control>

In the image forming apparatus 100, a toner charging amount affects an image density. The toner charging amount is correlated with the toner density of the developer. Therefore, in order to maintain the toner density of the developer within a predetermined range, auto toner replenish (ATR) control is executed by a control unit 110. Through the execution of the auto toner replenish control, the amount of toner corresponding to the amount of toner consumption during image formation is replenished from a hopper 111 into the developing container 40. For example, the control unit 110 calculates a toner consumption amount for one recording material P from the density and an area of an image to be formed. Then, the control unit 110 calculates an appropriate toner replenishing amount in accordance with the toner density detected by using a magnetic permeability sensor (inductance sensor).

<Magnetic Permeability Sensor>

A magnetic permeability sensor 80 is used to detect the toner density of the developer stored in the developing container 40 (in developing container). As illustrated in FIG. 3, the magnetic permeability sensor 80 is arranged on a wall surface on a side closer to the agitating chamber 42, which is opposed to the partition wall 70 across the agitating screw 61. The magnetic permeability sensor 80 is provided so that a detecting portion 80*a* projects toward the agitating screw 61. Specifically, as illustrated in FIG. 2, the magnetic permeability sensor 80 is arranged beside the agitating screw 61 in the horizontal direction. Further, the magnetic permeability sensor 80 is arranged upstream of the agitating screw 61 in a direction of conveyance of the developer as compared to the second communication portion 44 for bringing the agitating chamber 42 and the developing chamber 41 into communication with each other.

The magnetic permeability sensor 80 serving as a detection unit uses an inductance of a coil to output a voltage value (output value) in accordance with a change in magnetic permeability of the developer. In the magnetic permeability sensor 80, when the toner density of the developer decreases, a rate of the magnetic carrier contained in the developer in a unit volume increases to increase an apparent magnetic permeability of the developer, resulting in an increase in peak voltage. In contrast, in the magnetic permeability sensor 80, when the toner density of the developer increases, a rate of the magnetic carrier contained in the developer in the unit volume decreases to decrease the apparent magnetic permeability of the developer, resulting in a reduction in peak voltage. A configuration of the magnetic permeability sensor 80 is described with reference to FIG. 4 to FIG. 6.

Figure 4:
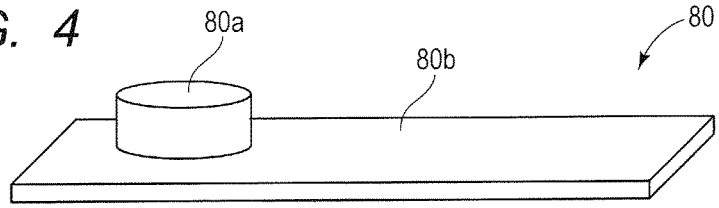
FIG. 4 is a perspective view for illustrating an outer appearance of a magnetic permeability sensor.

As illustrated in FIG. 4, the magnetic permeability sensor 80 is roughly divided into the detecting portion 80*a* and a board portion 80*b*. The detecting portion 80*a* is formed into a columnar shape so as to project from the board portion 80*b*. In the detecting portion 80*a*, a coil unit configured to form a magnetic field in accordance with energization is arranged. The coil unit includes a drive coil, a detection coil, and a reference coil (see FIG. 6). The board portion 80*b* includes electronic components of an LC oscillator circuit other than the coil unit, and is electrically connected to the detecting portion 80*a*. The electronic components include a capacitor, a semiconductor integrated circuit (IC), and a resistor (see FIG. 6). The magnetic permeability sensor 80 is arranged so that the board portion 80*b* is at least partially exposed outside of the developing container 40 (outside of the developing container) and the detecting portion 80*a* projects into the developing container 40.

Figure 5:
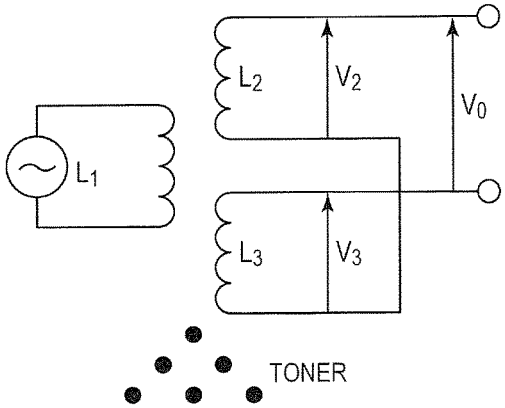
FIG. 5 is a diagram for illustrating a detection principle of the sensor.

A detection principle of the magnetic permeability sensor 80 is described briefly. FIG. 5 is an explanatory diagram of the detection principle of the magnetic permeability sensor 80. In a case of the first embodiment, the magnetic permeability sensor 80 employs a principle of a differential transformer. The differential transformer includes a drive coil L1, a reference coil L2, and a detection coil L3, which are provided to the same core. When the drive coil L1 is driven at an AC voltage at a high frequency, for example, 500 kHz, a differential output "V0=V2−V3" is output. In this case, a voltage of the reference coil L2 is denoted by "V2", and a voltage of the detection coil L3 is denoted by "V3". When a voltage of the detection coil L3 at a standard toner density, for example, 8% is "V30" and a voltage of the reference coil L2 at the standard toner density is "V20", the magnetic permeability sensor 80 outputs "V0=V20−(V30+ΔV3)=−ΔV3" for a voltage change "ΔV3" of the detection coil L3.

Figure 6:
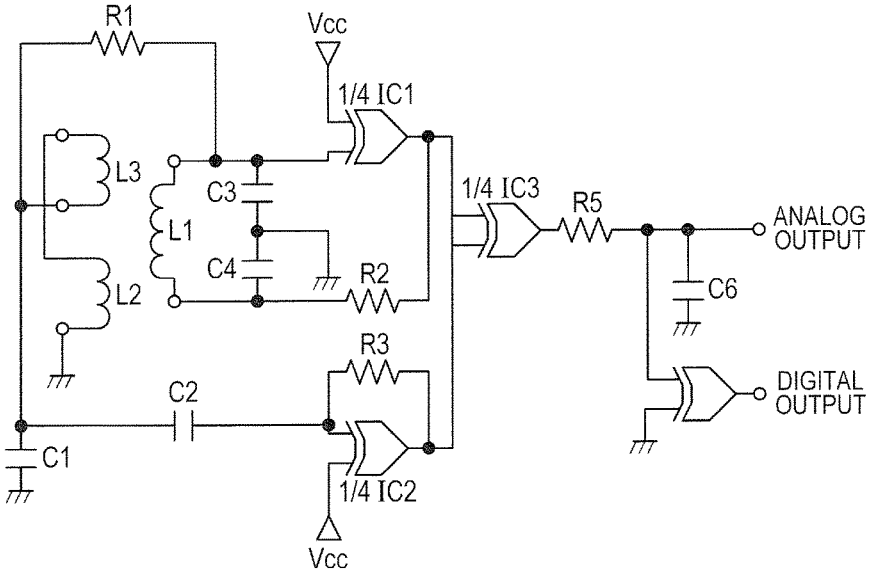
FIG. 6 is a circuit diagram for illustrating a circuit of the sensor.

In FIG. 6, an example of a circuit configuration of the magnetic permeability sensor 80 is illustrated. The LC oscillator circuit illustrated in FIG. 6 includes the electronic components, such as the capacitor, the semiconductor integrated circuit (IC), and the resistor in addition to the coil unit (the drive coil L1, the reference coil L2, and the detection coil L3) which constructs the differential transformer. With the circuit configuration illustrated in FIG. 6, the magnetic permeability sensor 80 directly outputs the voltage change "ΔV3" of the detection coil L3. The circuit configuration of the magnetic permeability sensor 80 is not limited to the circuit configuration illustrated in FIG. 6, and may be any circuit configuration as long as a change in magnetic permeability can be detected.

Figure 7:
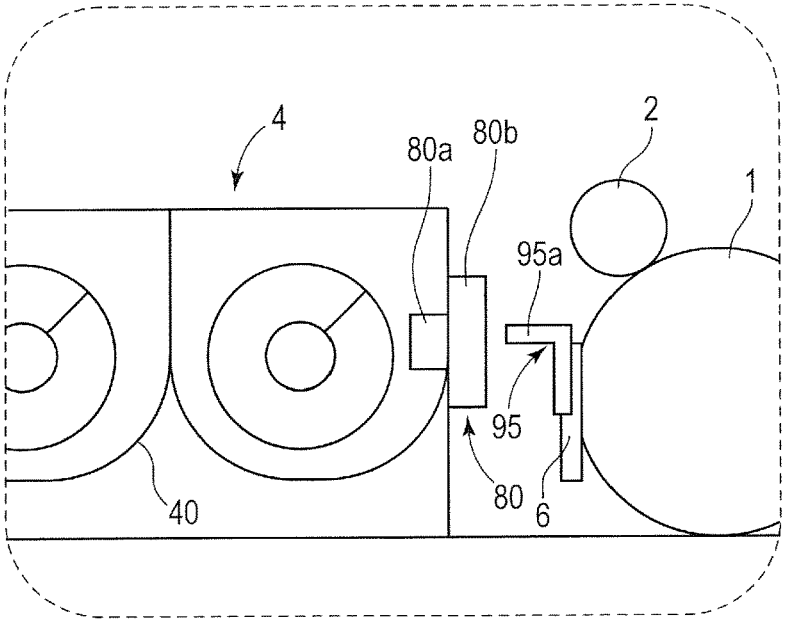
FIG. 7 is a schematic view for illustrating a support member.

In the above-mentioned image forming apparatus 100 having the tandem configuration, each of the image forming units is arranged so that an interval between the adjacent image forming units is reduced as much as possible in order to achieve downsizing. In a case of the first embodiment, the image forming units UY, UC, UM, and UK are arranged adjacent to each other so that an interval between the image forming unit UK and the image forming unit UC, an interval between the image forming unit UC and the image forming unit UM, and an interval between the image forming unit UM and the image forming unit UY in the stated order from the left side in FIG. 1 become equal to each other and as small as possible. In this case, the magnetic permeability sensor 80 of one of the adjacent image forming units and the support member 95 of another image forming unit are provided in proximity so as to be opposed to each other, as illustrated in FIG. 7. The support member 95 is bent toward downstream in the direction of rotation of the intermediate transfer belt 10 so as to be mountable to a casing (not shown) that accommodates the photosensitive drum 1. A distal end portion of a bent portion 95*a* is exposed from the casing. At the exposed portion of the bent portion 95*a*, the support member 95 and the magnetic permeability sensor 80 are closest to each other.

The magnetic permeability sensor 80 generates a magnetic field at the detecting portion 80*a* in accordance with energization. The magnetic field is generated on both surfaces of the detecting portion 80*a*, and is therefore generated not only inside but also outside of the developing container 40, specifically, on the support member 95 side to pass through the board portion 80*b*. Therefore, as the interval between the adjacent image forming units decreases, the magnetic permeability sensor 80 is more magnetically affected by the support member 95. Specifically, when the AC voltage is applied to the drive coil L1 (see FIG. 5) so as to operate the magnetic permeability sensor 80, a primary magnetic field is generated by the drive coil L1 while changing orientation of the primary magnetic field (specifically, being inverted) as needed. The inverted primary magnetic field induces an eddy current in the support member 95, and the eddy current generates a secondary magnetic field. The secondary magnetic field is a repulsive magnetic field acting in an orientation in which the primary magnetic field is repulsed, and therefore affects the primary magnetic field. An output value of the magnetic permeability sensor 80 may vary depending on whether or not the magnetic permeability sensor 80 is magnetically affected by the support member 95. This is because a detection sensitivity for the toner density is varied by proximity providing the conductive member in the vicinity of the magnetic permeability sensor 80.

The control unit 110 determines the toner density of the developer based on the output value of the magnetic permeability sensor 80 corresponding to the change in magnetic permeability of the developer. The control unit 110 maintains the toner density in the developing container 40 within a predetermined range based on the output value of the magnetic permeability sensor 80. In order to maintain the toner density within the predetermined range, the output values of the magnetic permeability sensors 80 are required to be the same in the image forming units UY to UK when the toner densities are approximately the same.

In a case of the first embodiment, as illustrated in FIG. 1, for the yellow image forming unit UY arranged most upstream in the direction of rotation of the intermediate transfer belt 10, another image forming unit is not arranged upstream of the developing device 4Y. The support member 95 provided in proximity to the developing device 4Y of the image forming unit UY is not present. Therefore, with this arrangement, the output value of each of magnetic permeability sensors 80 (first detection unit) of the respective image forming units UM to UK that are magnetically affected by the support members 95 and the output value of the magnetic permeability sensor 80 (second detection unit)

of the image forming unit UY that is not magnetically affected by the support member 95 are different from each other. Then, although the actual toner densities are approximately the same, for example, fall within a range of ±0.5% of an average value of all the toner densities in all the image forming units UY to UK, the control unit 110 erroneously determines that the toner density of the image forming unit UY and the toner densities of the other image forming units UM to UK are different from each other.

In order to prevent the erroneous determination, a conductive member 96 is provided. With the conductive member 96, the output values of the magnetic permeability sensors 80 become the same for the image forming units UM to UK that are magnetically affected by the support members 95 and the image forming unit UY which is not magnetically affected by the support member 95 (the same for the detection unit other than the first detection units). The conductive member 96 is provided at the same interval as the interval between the support member 95 and the magnetic permeability sensor 80 so as to be opposed to the magnetic permeability sensor 80 other than the magnetic permeability sensors 80 opposed to the respective support members 95. In a case of the first embodiment, as illustrated in FIG. 1, for the yellow image forming unit UY for which another image forming unit is not arranged on the developing device 4Y side, the conductive member 96 is provided in proximity to the developing device 4Y. The conductive member 96 is now described with reference to FIG. 8 to FIG. 11.

Figure 8:
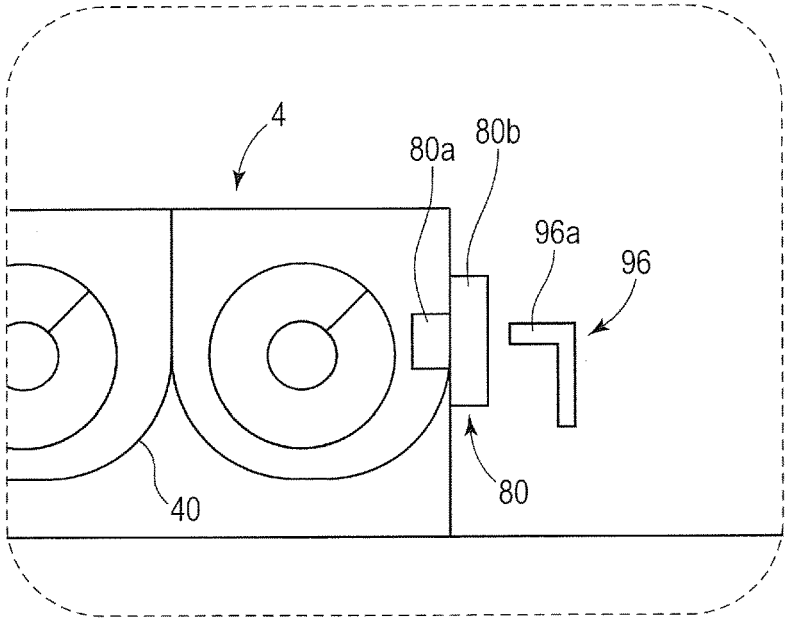
FIG. 8 is a schematic view for illustrating a conductive member.

The conductive member 96 is made of the same material and has the same size and shape as those of the support member 95. Specifically, the conductive member 96 is formed by using a metal member having high stiffness and conductivity such as stainless steel (SUS) or aluminum. The conductive member 96 and the support member 95 can be formed by using a high stiffness metal having an electric resistivity p falling within a range that is equal to or less than $10^{-5}$ (Ωm) and equal to or greater than $10^{-8}$ (Ωm). It is more preferred that the electric resistivity p be $10^{-7}$ (Ωm). As illustrated in FIG. 8, the conductive member 96 is bent toward downstream in the direction of rotation of the intermediate transfer belt 10 so as to be mounted to an apparatus main body. Therefore, similarly to the support member 95, even for the conductive member 96, a distal end of a bent portion 96*a* is closest to the magnetic permeability sensor 80.

Figure 9:
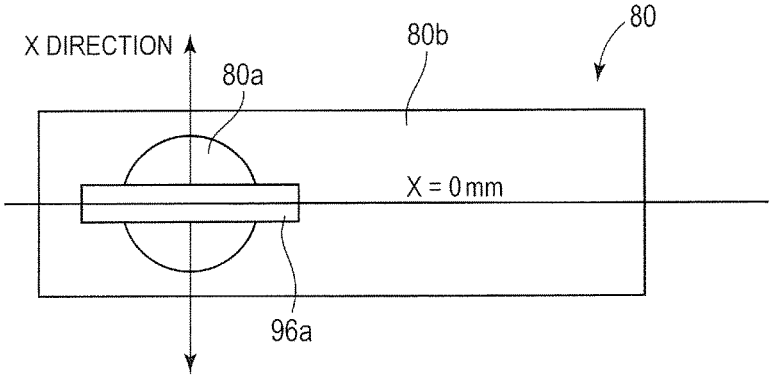
FIG. 9 is a diagram for illustrating a position of the conductive member with respect to the sensor.

As illustrated in FIG. 9, similarly to the support member 95, the conductive member 96 is provided so that the bent portion 96*a* is opposed to at least a part of the board portion 80*b*, more specifically, to the detecting portion 80*a*. Further, similarly to the support member 95, the conductive member 96 is arranged so that an interval between the distal end of the bent portion 96*a* and the magnetic permeability sensor 80, more specifically, the detecting portion 80*a*, becomes an interval described later. In other words, the conductive member 96 is arranged so as to affect the magnetic field that is generated by the detecting portion 80*a* and passes through the board portion 80*b*.

When the support member 95 or the conductive member 96 is provided in proximity to the magnetic permeability sensor 80, the support member 95 or the conductive member 96 affects the output value of the magnetic permeability sensor 80. In this context, a range in which the support member 95 and the conductive member 96 can affect the output value of the magnetic permeability sensor 80 is now described. First, the range in which the output value is affected in a short direction of the magnetic permeability sensor 80 is described with reference to FIG. 10. The range in which the output value is affected with respect to the interval between the magnetic permeability sensor 80 and the support member 95 or the conductive member 96 is described with reference to FIG. 11.

Figure 10:
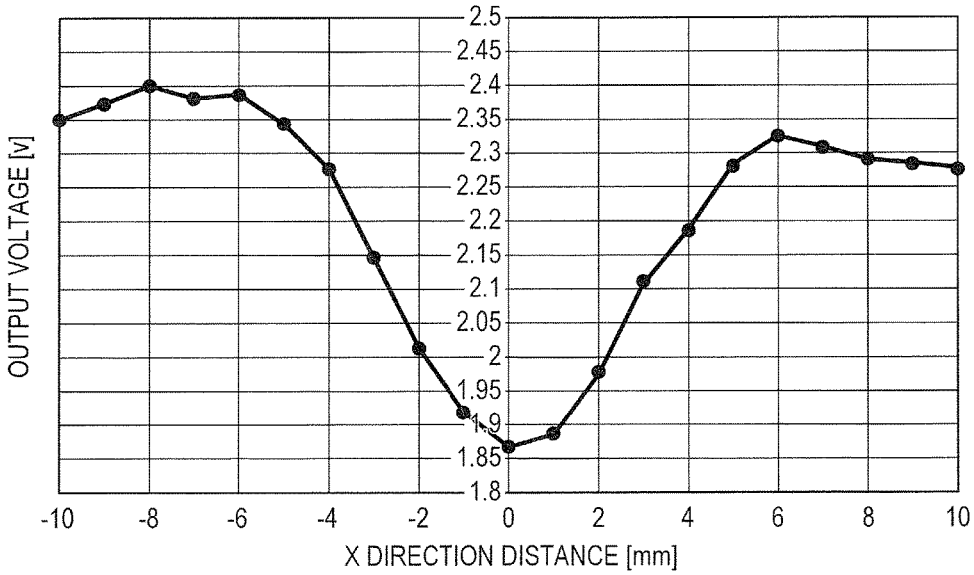
FIG. 10 is a graph for showing a change in sensor output when the position of the conductive member is changed with respect to the sensor in a short direction.

The inventors of the present invention have verified that, in a case of the first embodiment, for example, for a radial direction of the detecting portion 80*a* having a diameter of 20 mm, the output value of the magnetic permeability sensor 80 is affected by the conductive member 96 (or the support member 95; the same applies to the following) when the conductive member 96 is present within a radius of 10 mm from a center of the detecting portion 80*a*. FIG. 10 shows a change in output value (output voltage) of the magnetic permeability sensor 80 when the conductive member 96, more specifically, the distal end of the bent portion 96*a*, is moved from the center of the detecting portion 80*a* in the short direction of the magnetic permeability sensor 80 (an X direction in FIG. 9) as illustrated in FIG. 9. A control voltage is applied to the magnetic permeability sensor 80 so that the output value becomes about 1.85 V at a position at which X is equal to 0 mm.

As shown in FIG. 10, as the conductive member 96 moves away from the center of the detecting portion 80*a*, the output value increases. Both at 6 mm and −6 mm, the change in output value is large. When exceeding 6 mm, the change in output value becomes smaller. Specifically, a range of ±6 mm from the center of the detecting portion 80*a* is a range in which the output value of the magnetic permeability sensor 80 is affected by the conductive member 96. Therefore, the conductive member 96 can be provided within the range of ±6 mm in the short direction of the magnetic permeability sensor (the X direction in FIG. 9). However, the output value becomes about 2.325 V when the conductive member 96 is positioned, for example, at +6 mm. Thus, a dynamic range is reduced as compared with a case where the conductive member 96 is positioned at 0 mm. In this case, a resolution of the magnetic permeability sensor 80 is decreased, and hence detection with higher accuracy becomes difficult to be achieved. Therefore, it is more preferred that the conductive member 96 be arranged at a position close to 0 mm in the short direction of the magnetic permeability sensor 80.

Figure 11:
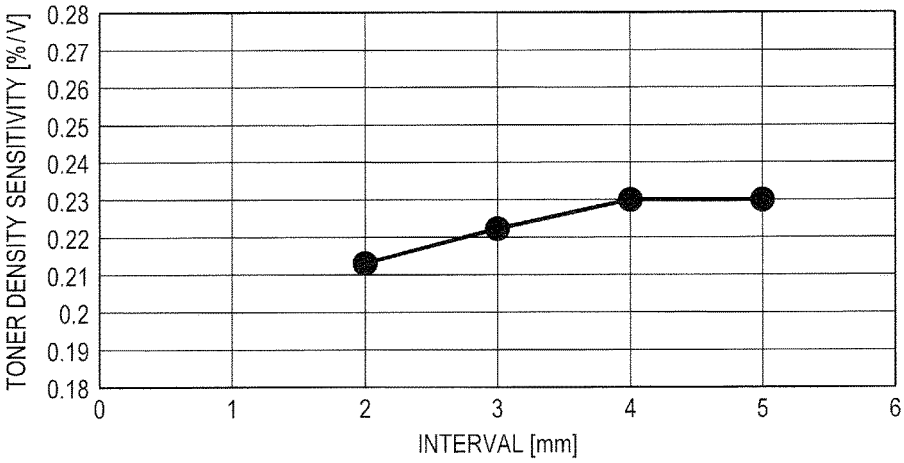
FIG. 11 is a graph for showing a change in sensor output when an interval between the sensor and the conductive member is changed.

In FIG. 11, a change in toner density sensitivity (%/V) of the magnetic permeability sensor 80 when the interval between the board portion 80*b* of the magnetic permeability sensor 80 (more specifically, a back surface side on which the detecting portion 80*a* is not provided) and the conductive member 96 (more specifically, the distal end of the bent portion 96*a*) is changed. Here, a rate of change in output value in accordance with a given change in toner density is referred to as "toner density sensitivity (%/V)". For example, when the output value is changed by 0.22 (V) for the change in toner density by 1%, the toner density sensitivity (%/V) is "0.22".

As shown in FIG. 11, the toner density sensitivity increases until the interval between the board portion 80*b* and the conductive member 96 becomes equal to or larger than 4 mm. When the interval between the board portion 80*b* and the conductive member 96 becomes equal to or larger than 4 mm, the toner density sensitivity remains unchanged at about 0.23 (%/V). That is, a range in which the interval between the board portion 80*b* and the conductive member 96 is smaller than 4 mm is a range in which the output value of the magnetic permeability sensor 80 is affected by the conductive member 96. Therefore, even in terms of downsizing of the image forming apparatus 100, the conductive member 96 may be arranged so that the interval between the distal end of the bent portion 96*a* and the magnetic permeability sensor 80, more specifically, the board portion 80*b*, becomes closer to 2 mm.

The support member 95 or the conductive member 96 may affect the output value of the magnetic permeability sensor 80. In this case, the dynamic range at which the change in magnetic permeability of the developer can be detected by the magnetic permeability sensor 80 is decreased as compared with a case where the output value of the magnetic permeability sensor 80 is not affected by the support member 95 or the conductive member 96. Therefore, the control unit 110 increases the control voltages applied to the drive coils L1 (see FIG. 5) for all the magnetic permeability sensors 80 so as to prevent the dynamic range from being reduced, as compared to the case where the output value of the magnetic permeability sensor 80 is not affected by the support member 95 or the conductive member 96.

As described above, in the first embodiment, for the image forming unit UY including the magnetic permeability sensor 80 to which the support member 95 is not arranged in proximity, the conductive member 96 having conductivity, which is similar to the support member 95, is arranged in proximity to the magnetic permeability sensor 80. The conductive member 96 exerts, on the magnetic permeability sensor 80 to which the conductive member 96 is arranged in proximity, the same effect as the magnetic effect exerted by the support member 95 on the magnetic permeability sensor 80 arranged in proximity thereto. Thus, the change in output value, which is caused by arranging the conductive member in the vicinity of the magnetic permeability sensor 80, occurs in a similar manner in all the image forming units UY to UK. As described above, in the case of the tandem configuration in which the plurality of image forming units UY to UK are arranged side by side, the magnetic permeability sensors 80 in the image forming units UY to UK are similarly magnetically affected. Therefore, when the toner densities in the developing containers 40 of the image forming units UY to UK are the same, the toner densities detected by the magnetic permeability sensors 80 of the image forming units UY to UK result in the same density.

Second Embodiment

Figure 12:
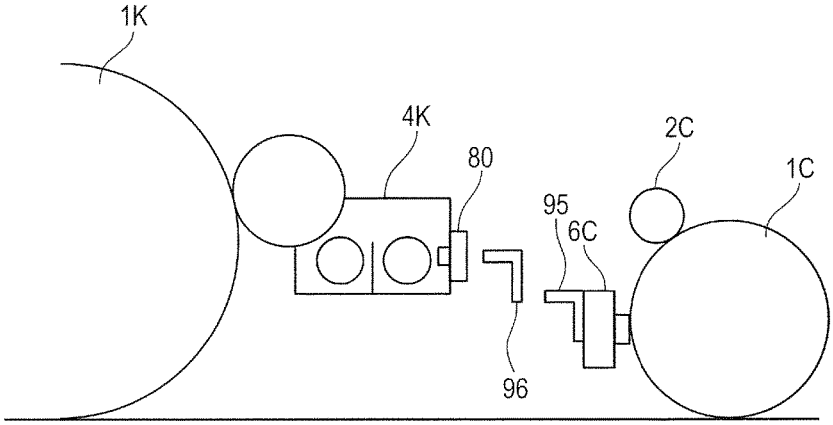
FIG. 12 is a schematic view for illustrating a part of a configuration of an image forming apparatus according to a second embodiment of the present invention.

A schematic configuration of an image forming apparatus according to a second embodiment of the present invention is described with reference to FIG. 12. In the image forming apparatus illustrated in FIG. 12, a diameter of the photosensitive drum 1K (second image bearing member) of the black image forming unit UK is larger than a diameter of each of photosensitive drums 1Y to 1C (first image bearing member) of the respective other image forming units UY to UC. The image forming apparatus of the second embodiment differs from the image forming apparatus 100 of the first embodiment in this point.

In the image forming unit UK, because of the larger diameter of the photosensitive drum 1K, the arrangement of the developing device 4K and the cleaning blade (not shown) is different from that in the other image forming units UY to UC. Thus, although the image forming unit UC is arranged upstream of the image forming unit UK, the support member 95 of the image forming unit UC is not arranged in proximity to the magnetic permeability sensor 80 of the image forming unit UK. Thus, the conductive member 96 is arranged in proximity to the magnetic permeability sensor 80 of the image forming unit UK in the image forming apparatus of the second embodiment. The conductive member 96 is similar to that of the first embodiment, and therefore a description thereof is herein omitted.

Another Embodiment

When the support member 95 is arranged in proximity to the magnetic permeability sensor 80 as the conductive member 96, the laborious formation of the conductive member 96 may be omitted. Further, the support member 95 can be installed as the conductive member 96 in a simple manner. When the toner densities of the image forming units UY to UK are the same, the material, the size, and the shape of the conductive member 96 are not required to be the same as those of the support member 95 as long as the output values of all the magnetic permeability sensors 80 become approximately equal to each other within a range of about ±5%.

In the embodiments described above, the image forming apparatus is configured to primarily transfer the toner images of the respective colors from the photosensitive drums 1 of the respective colors onto the intermediate transfer belt 10, and then secondarily transfer a compound toner image of the respective colors onto the recording material P at a time. However, the image forming apparatus is not limited thereto. For example, the image forming apparatus may use a direct transfer method for transferring the toner images from the photosensitive drums 1 directly onto the recording material P that is carried and conveyed by a transfer member conveying belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-098076, filed May 16, 2016, which is hereby incorporated by reference herein in its entirety.

What is claimed is:

1. An image forming apparatus, comprising:

a plurality of image forming units including a first image forming unit and a second image forming unit;

a rotatable and endless intermediate transfer member configured to transfer an image formed by each of the plurality of image forming units; and a conductive metal plate, wherein the first image forming unit is arranged downstream of a transfer position, at which the image transferred onto the intermediate transfer member is transferred onto a recording material, with respect to a rotational direction of the intermediate transfer member, and is arranged most upstream among the plurality of image forming units with respect to the rotational direction, and the second image forming unit is arranged adjacent to the first image forming unit and is arranged downstream of the first image forming unit with respect to the rotational direction, wherein the first image forming unit comprises:

a first image bearing member;

a first developing device having a first developing container which contains a first developer including a toner of first color and a carrier, the first developing device having a first developing rotary member configured to bear and convey the first developer to a position at which an electrostatic image formed on the first image bearing member is to be developed, a first magnetic permeability sensor arranged on the first developing device and configured to detect magnetic permeability of the first developer so as to detect a toner density of the first developer, the first magnetic permeability sensor including a first base portion and a first detecting portion which is arranged on the first base portion along a rotation axis direction of the first developing rotary member to detect the magnetic permeability of the first developer; and a first cleaning unit configured to remove residual toner from the first image bearing member, the first cleaning unit having a first cleaning blade configured to contact with the first image bearing member to remove the residual toner from the first image bearing member and a conductive first metal support plate configured to support the first cleaning blade, wherein the second image forming unit comprises:

a second image bearing member;

a second developing device having a second developing container which contains a second developer including a toner of second color and a carrier, the second developing device having a second developing rotary member configured to bear and convey the second developer to a position at which an electrostatic image formed on the second image bearing member is to be developed, the second developing device arranged downstream of the first cleaning unit with respect to the rotational direction so as to be adjacent to the first cleaning unit;

a second magnetic permeability sensor arranged on the second developing device and configured to detect magnetic permeability of the second developer so as to detect a toner density of the second developer, the second magnetic permeability sensor including a second base portion and a second detecting portion which is arranged on the second base portion along a rotation axis direction of the second developing rotary member to detect the magnetic permeability of the second developer; and a second cleaning unit configured to remove residual toner from the second image bearing member, the second cleaning unit having a second cleaning blade configured to contact with the second image bearing member to remove the residual toner from the second image bearing member and a conductive second metal support plate configured to support the second cleaning blade, wherein, when viewed from a direction perpendicular to the rotation axis direction of the second developing rotary member, a shortest distance between the first metal support plate and the second detecting portion is equal to or less than 10 mm, and wherein, when viewed from a direction perpendicular to the rotation axis direction of the first developing rotary member, the conductive metal plate overlaps the first detecting portion with respect to the rotation axis direction of the first developing rotary member and a shortest distance between the conductive metal plate and the first detecting portion is equal to or less than 10 mm.

2. The image forming apparatus according to claim 1, wherein, when viewed from the direction perpendicular to the rotation axis direction of the first developing rotary member, the shortest distance between the conductive metal plate and the first detecting portion is equal to or less than 6 mm.

3. The image forming apparatus according to claim 2, wherein when viewed from the direction perpendicular to the rotation axis direction of the second developing rotary member, the shortest distance between the first metal support plate and the second detecting portion is equal to or less than 6 mm.

4. The image forming apparatus according to claim 1, wherein, when viewed from the direction perpendicular to the rotation axis direction of the first developing rotary member, a shortest distance between the conductive metal plate and the first base portion is equal to or less than 4 mm.

5. The image forming apparatus according to claim 4, wherein, when viewed from the direction perpendicular to the rotation axis direction of the second developing rotary member, a shortest distance between the first metal support plate and the second base portion is equal to or less than 4 mm.

6. The image forming apparatus according to claim 1, wherein an electric resistivity of the conductive metal plate is equal to or greater than $10^{-8}$ Ωm and equal to or less than $10^{-5}$ Ωm.

7. The image forming apparatus according to claim 6, wherein an electric resistivity of the first metal support plate is equal to or greater than $10^{-8}$ Ωm and equal to or less than $10^{-5}$ Ωm.

8. The image forming apparatus according to claim 1, wherein the first magnetic permeability sensor is mounted to the first developing container in a state that the first detecting portion projects into an opening portion of the first developing container, and wherein the second magnetic permeability sensor is mounted to the second developing container in a state that the second detecting portion projects into an opening portion of the second developing container.

* * * * *